US007904002B2

(12) United States Patent
Akedo

(10) Patent No.: US 7,904,002 B2
(45) Date of Patent: Mar. 8, 2011

(54) DEVELOPING DEVICE AND IMAGE FORMING APPARATUS WITH A FLOW GUIDE PLATE

(75) Inventor: Shuichi Akedo, Sakai (JP)

(73) Assignee: Sharp Kabushiki Kaisha, Osaka (JP)

( * ) Notice: Subject to any disclaimer, the term of this patent is extended or adjusted under 35 U.S.C. 154(b) by 371 days.

(21) Appl. No.: 12/177,910

(22) Filed: Jul. 23, 2008

(65) Prior Publication Data

US 2009/0041506 A1 Feb. 12, 2009

(30) Foreign Application Priority Data

Aug. 10, 2007 (JP) ..... 2007-210115

(51) Int. Cl.
*G03G 15/08* (2006.01)

(52) U.S. Cl. ..... 399/254

(58) Field of Classification Search ..... 399/30, 399/254, 264, 273, 283
See application file for complete search history.

(56) References Cited

U.S. PATENT DOCUMENTS 5,091,749 A 2/1992 Iida et al.

FOREIGN PATENT DOCUMENTS

| | | | |
|---|---|---|---|
| JP | 62-50860 | A | 3/1987 |
| JP | 63-74652 | | 5/1988 |
| JP | 3-35267 | A | 2/1991 |
| JP | 3-39766 | A | 2/1991 |
| JP | 2006-154151 | A | 6/2006 |
| JP | 2006-154235 | | 7/2006 |

*Primary Examiner* — Quana M Grainger
(74) *Attorney, Agent, or Firm* — Nixon & Vanderhye, PC

(57) ABSTRACT

A developing device for developing an electrostatic latent image formed on an image bearer with a dual-component developer, includes: a developing hopper for storing the developer; an agitation and conveying member for conveying the developer while agitating; a developer support which supports the developer that has been mixed and agitated inside the developing hopper and supplies the developer to a developing area located opposing the image bearer; a layer thickness-regulating member for regulating the layer thickness of the developer being conveyed by the developer support; a flow-guide plate member for flowing down the surplus developer that was rejected and conveyed away from the layer thickness-regulating member; a multiple number of diffusing elements arranged upright on the flow-guided plate member for flowing down the surplus developer in a predetermined direction whilst diffusing the developer with respect to the longitudinal direction of the developer support; and a downflow direction turning mechanism for periodically turning the downflow direction of the surplus developer regulated by the diffusing elements.

15 Claims, 8 Drawing Sheets

FIG. 8

Table 1: Relationship between Set Conditions and Evaluation on Image Quality in Examples and Comparative Examples

| Examples | Print pattern (print coverage %) | Developing roller's continuous drive time (min) | Developing roller's rotational speed (mm/sec) | Presence of reciprocation of partitioning ribs (count/min) | Addition of reciprocation of partitioning ribs (count/min) | Toner conc. in developing hopper before and after test (wt% in absolute value) | Evaluation on image quality (print density) |
|---|---|---|---|---|---|---|---|
| Example 1 | 5 | 9 | 864 | 2 | — | 0.05 | 0.04 |
| Example 2 | 10 | 9 | 864 | 4 | — | 0.03 | 0.03 |
| Example 3 | 30 | 9 | 864 | 12 | — | 0.08 | 0.05 |
| Comparative Example 1 | 5 | 9 | 864 | None | — | 0.31 | 0.10 |
| Comparative Example 2 | 30 | 9 | 864 | None | — | 0.60 | 0.16 |
| Example 4 | 10 | 18 | 432 | 2 | — | 0.06 | 0.02 |
| Comparative Example 3 | 10 | 18 | 432 | None | — | 0.14 | 0.06 |
| Example 5 | 10 | 30 | 864 | 4 | 2 | 0.06 | 0.06 |
| Example 6 | 10 | 60 | 864 | 4 | 4 | 0.03 | 0.04 |
| Example 7 | 10 | 60 | 864 | 4 | — | 0.08 | 0.09 |

DEVELOPING DEVICE AND IMAGE FORMING APPARATUS WITH A FLOW GUIDE PLATE

This Nonprovisional application claims priority under 35 U.S.C. §119(a) on Patent Application No. 2007-210115 filed in Japan on 10 Aug. 2007, the entire contents of which are hereby incorporated by reference.

BACKGROUND OF THE TECHNOLOGY

1. Field of the Technology

The technology relates to a developing device for visualizing an electrostatic latent image formed on a photoreceptor etc. with a developer, in particular relating to an agitating mechanism for dual-component developer composed of toner and carrier.

2. Description of the Prior Art

The developing device using a dual-component developer in an image forming apparatus such as a digital multifunctional machine or the like incorporates a developing roller opposing a photoreceptor, an agitating roller and a toner supply and agitation roller, all being arranged rotatably in the developing hopper. Formed over the toner supply and agitation roller is a toner supply port, over which a toner supply container is attached.

An excessive amount of developer that was separated from the developing roller by the layer thickness-regulating member inside the developing hopper passes by a flow-guide plate arranged nearby and is returned to the upside of the agitating roller. This surplus developer is mixed and agitated with the supplied toner and then fed once again to the developing roller. Further, there are many cases that the flow-guide plate is formed with partitioning ribs in order to prevent occurrence of uneven distribution of the developer inside the developing hopper.

In the prior art, since partitioning ribs 347 formed on the flow-guide plate do not move as shown in FIG. 1, the surplus developer that was separated by an unillustrated layer thickness-regulating member will not move in the longitudinal direction of the developing roller, designated at 341 and is returned sliding over a flow-guide plate 346 to the upside of an unillustrated agitating roller. For this reason, agitation of the developer in the longitudinal direction of developing roller 341 relies on the rotation of the agitating roller alone, hence there occurred many cases where it takes long time for agitation or where a lack of agitation takes place.

As a countermeasure to deal with this problem, a patent document 1 (Japanese Patent Application Laid-open 2006-154235) discloses a technique in which the developer returned from the flow-guide plate and the toner supplied from above are made to pass through an AC magnetic field generator so as to improve agitating and mixing performance.

In recent high-speed digital multi-functional machines, there are cases that image unevenness occurs when printing of the same print pattern has been continuously performed. That is, in a dual-component developing device, it is assumed that the dual-component developer having a uniform toner concentration is supplied to the developing roller using the agitating roller and the like so as to make the toner concentration uniform along the longitudinal direction of the developing roller. However, in the real situation, the amount of toner consumed from the developing roller is different depending on the print pattern, so that the toner concentration on the developing roller surface after development becomes different from one place to another. In this situation, when the toner concentration of the developer supplied to the developing roller is not uniform in the longitudinal direction, the toner concentration of the developer contributing to development resultantly becomes different across the length of the developing roller. This problem is particularly prone to occur for the developing roller that rotates at a high speed.

For example, when print patterns having a solid area in the central part have been continuously printed, the toner concentration of the developer has become lowered in the center across the length of the developing roller, hence causing image unevenness such that the necessary print density cannot be obtained. Accordingly, there occurs a large difference in the toner concentration of the dual-component developer between before and after it is agitated and mixed in the agitating roller area, hence the toner concentration will become uneven across the length of the developing roller even when the developer is supplied to the developing roller. Accordingly, the excessive dual-component developer is also different in toner concentration along the length of the developing roller when viewed microscopically.

However, the developing device disclosed in the aforementioned patent document 1 is constructed to focus on crushing toner aggregations, but the toner concentration across the length of the developing roller is not taken into consideration. Further, since this configuration takes such a structure that the developer is dropped through one place into the developing hopper, there has been the problem that it takes long time to make the developer concentration uniform.

SUMMARY OF THE TECHNOLOGY

The technology has been devised in view of the above problems entailing the conventional developing devices, it is therefore an object to provide a novel and improved developing device and image forming apparatus with which a dual-component developer of uniform toner concentration across the length of the developing roller can be quickly supplied.

In order to achieve the above object, the aspect of the technology resides in a developing device for developing an electrostatic latent image formed on an image bearer with a developer that has been triboelectrically-charged by mixing and agitation of two components, toner and magnetic carrier, comprising: a developing hopper for storing the developer; an agitation and conveying member that is rotated inside the developing hopper for conveying the developer while agitating; a developer support which supports the developer that has been mixed and agitated inside the developing hopper and supplies the developer whilst rotating to a developing area located opposing the image bearer; a layer thickness-regulating member for regulating the layer thickness of the developer being conveyed by the developer support; a flow-guide plate member for flowing down the surplus developer that was rejected by the layer thickness-regulating member to a place located away from the layer thickness-regulating member; a plurality of diffusing elements arranged upright on the flow-guide plate member for flowing down the surplus developer in a predetermined direction whilst diffusing the developer with respect to the longitudinal direction of the developer support; and a downflow direction turning mechanism controlled so as to periodically turn the downflow direction of the surplus developer regulated by the diffusing elements.

With the above configuration, the downflow direction of the surplus developer that is collected by the flow-guide plate and flows down over it is periodically turned by the diffusing elements, i.e., the partitioning ribs formed on the flow-guide plate, by means of the downflow direction turning mechanism. Accordingly, the surplus developer flowing down can be uniformly dispersed with respect to the longitudinal direction of the developing roller as the developer support and the mixing and agitation performance in the developing hopper can be improved. As a result, image unevenness originating from the developing device can be prevented by making toner concentration uniform across the length of the developing roller.

Further, in the above configuration, the downflow direction turning mechanism may be driven and controlled so as to change the cycle of turning the downflow direction which is regulated by the diffusing elements, in accordance with the amount of developer consumed from the developer support.

As a usual case, if unbalanced print patterns continue as a print job, the developer concentration becomes locally uneven along the longitudinal direction of the developing roller. With the above configuration, it is possible for the downflow direction turning mechanism to make the toner concentration uniform with a higher precision, by turning the downflow direction of the developer regulated by the partitioning ribs, in accordance with the status of the print patterns, or in accordance with the amount of developer to be consumed in the developing roller, based on the area separation analysis on the print information, for instance.

Also, in the above configuration, the downflow direction turning mechanism may be driven and controlled so as to change the cycle of turning the downflow direction which is regulated by the diffusing elements, in accordance with the rotational speed of the developer support.

It is usual that the rotational speed of the developing roller is changed with the change of the processing speed of print paper in image forming. Though the mixing and agitation performance of the dual-component developer lowers with the increase of the processing speed, it is possible to make the developer concentration uniform with a higher precision by shortening the cycle in which the downflow direction turning mechanism turns the downflow direction.

Further, in the above configuration, the diffusing element may be formed such that the height from the surface of the flow-guide plate member on which the diffusing element is set becomes smaller as it goes in the downflow direction.

It is usual that in the rear half portion of the partitioning ribs that is away from the layer thickness-regulating member, the surplus developer has been rather mixed and made substantially even within each passage between the partitioning ribs. Accordingly, such formation of the partitioning ribs that their height becomes lower in the rear half enables the surplus developer in adjacent passages between partitioning ribs to mix up, hence it is possible to make the developer concentration uniform with a higher precision.

In the above configuration, the downflow direction turning mechanism may be additionally driven and controlled every time a predetermined period of time has elapsed while the developer support has been continuously driven.

Though it is usual that the fluidity and mixing and agitation performance of the dual-component developer become lowered as use of the developer becomes longer, it is possible to make the toner concentration uniform with a higher precision when the downflow direction turning mechanism for turning the downflow direction by the partitioning ribs is additionally driven and controlled in accordance with the continuous drive time of the developing roller.

Further, the above configuration may includes a toner concentration detector that is arranged in the proximity to the area where the developer is supplied from the agitating and conveying member to the developer support, to detect the toner concentration of the developer.

Since arrangement of the toner concentration sensor immediately before bringing up the developer to the developing roller enables detection of the toner concentration directly before development, it is possible to realize high image quality over a long period of time.

Additionally, in order to solve the above problems, another aspect of the technology resides in an image forming apparatus including an image bearer for supporting an electrostatic latent image and any one of the above-described developing devices for visualizing the electrostatic latent image on the image bearer with toner.

Since the above configuration makes it possible to improve the mixing and agitation performance in the developing hopper by uniformly dispersing the surplus developer collected over the flow-guide plate, it is possible to prevent image unevenness originating from the developing device by making toner concentration uniform across the length of the developing roller.

As has been described, the surplus developer separated by the layer thickness-regulating member can be uniformly distributed across the length of the developing roller by periodically changing the downflow direction of the surplus developer using the movable partitioning ribs on the guide-flow plate. Accordingly, it is possible to improve the agitation and mixture of the surplus developer and supplied toner and hence suppress image unevenness originating from the developing device.

DESCRIPTION OF THE PREFERRED EMBODIMENTS

Figure 1:
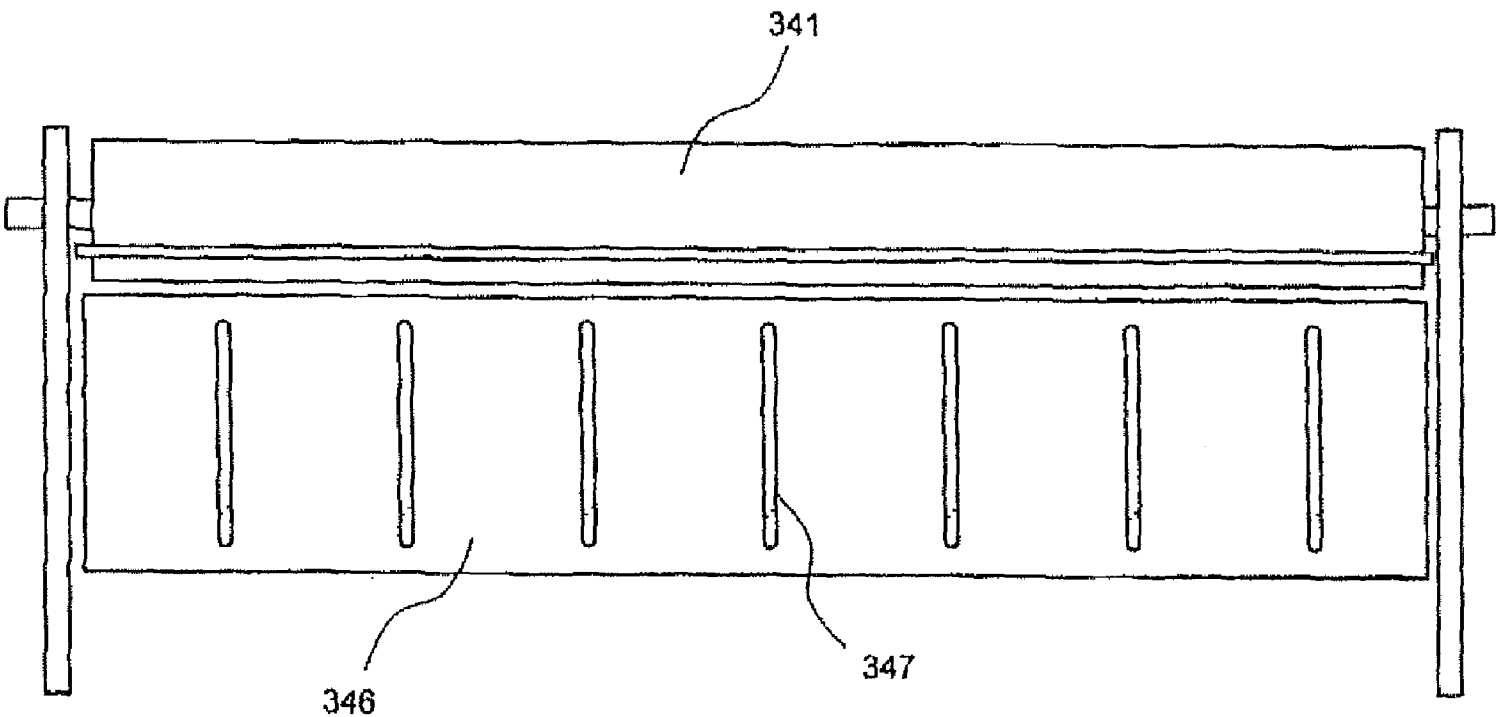
FIG. 1 Prior Art
FIG. 1 is a top view partially showing a developing device having conventional partitioning ribs.

Preferred embodiments of the technology will hereinafter be described in detail with reference to the accompanying drawings. In the specification and drawings, the constituents having essentially the same functional configurations will be allotted with the same reference numerals to omit repeated description.

Figure 2:
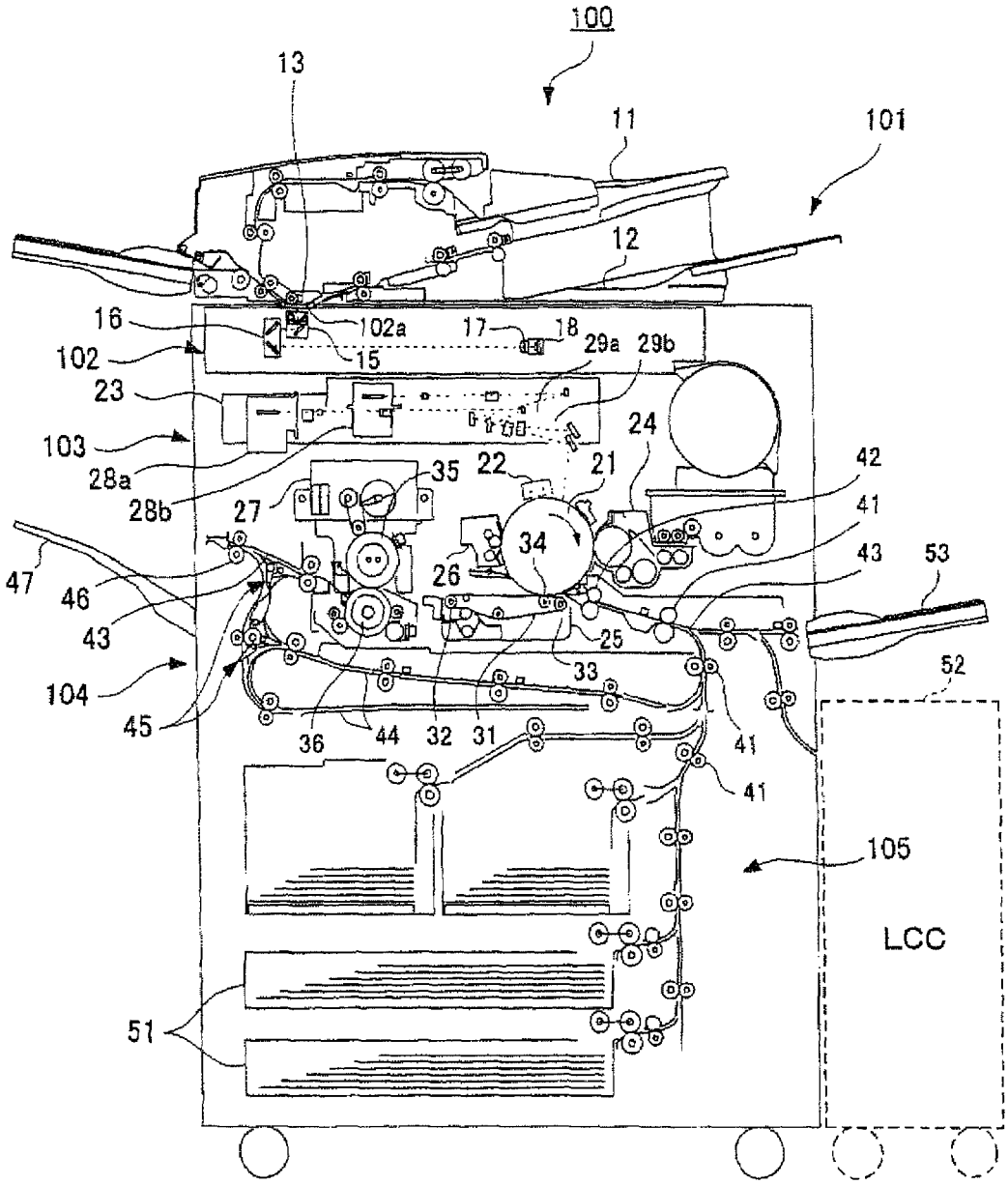
FIG. 2 is a view showing a configuration of an image forming apparatus as the first embodiment.

To begin with, the overall configuration of an image forming apparatus to which the first embodiment of the developing device is applied will be outlined with reference to FIG. 2.

An image forming apparatus 100 of the present embodiment is to form on a recording paper a monochrome image represented by the image data that was obtained, for example by scanning a document or that was received from without, and is essentially comprised of a document feeder (ADF) 101, an image reader 102, a printing portion 103, a recording paper conveyor 104 and a paper feeder 105.

In document feeder 101, when, at least, one document is set on a document set tray 11 and the documents are pulled out from document set tray 11, sheet by sheet, the document is conducted to and passed over a document reading window 102*a* of paper reader 102 and discharged to a document output tray 12.

A CIS (contact image sensor) 13 is arranged over document reading window 102*a*. This CIS 13 repeatedly reads the image on the rear side of the document in the main scan direction while the document is passing over document reading window 102*a*, to thereby output the image data that represents the image on the rear side of the document.

Further, image reader 102 illuminates the document surface with light from the lamp of a first scan unit 15 when the document passes over document reading window 102*a* and the reflected light from the document surface is lead to an image focusing lens 17 by way of the mirrors of first and second scan units 15 and 16, so that the image on the document surface is focused by image focusing lens 17 onto the a CCD (charge coupled device) 18. CCD 18 repeatedly reads the image of the document surface in the main scan direction to thereby output image data that represents the image on the document surface.

On the other hand, when the document is placed on the platen glass on the top of image reader 102, first and second scan units 15 and 16 are moved keeping a predetermined speed relationship relative to each other while the document surface on the platen glass is illuminated by first scan unit 15, and the light reflected off the document surface is lead to image focusing lens 17 by means of first and second scan units 15 and 16 so that the image on the document surface is focused by image focusing lens 17 onto CCD 18.

The image data output from CIS 13 or CCD 18 is subjected to various kinds of image processes by a control circuit such as a microcomputer etc. and then output to printing portion 103.

Printing portion 103 is to record the document images represented by image data on sheets of paper and includes a photoreceptor drum 21, a charger 22, an exposure unit 23, a developing device 24, a transfer device 25, a cleaning unit 26, a fixing unit 27 and the like.

While photoreceptor drum 21 rotates in one direction, its surface is cleaned by cleaning unit 26 and then charged uniformly by charger 22. Charger 22 may be either a corona discharge type or a roller or brush type that contacts with photoreceptor drum 21.

Exposure unit 23 is a laser scanning unit (LSU) including two laser emitters 28*a* and 28*b* and two mirror groups 29*a* and 29*b*. This exposure unit 23 receives image data and emits laser beams from laser emitters 28*a* and 28*b* in accordance with the image data. These laser beams are radiated on photoreceptor drum 21 by way of respective mirror groups 29*a* and 29*b* to thereby illuminate the photoreceptor drum 21 surface that has been uniformly electrified, forming an electrostatic latent image on the photoreceptor drum 21 surface.

In order to achieve a high-speed printing operation, this exposure unit 23 employs a two-beam system including two laser emitters 28*a* and 28*b* to thereby reduce the burden entailing the high frequency of irradiation.

Here, as the exposure unit 23, an array of light emitting elements, e.g., an EL writing head or LED writing head may be used instead of the laser scanning unit.

Developing device 24 supplies toner to the photoreceptor drum 21 surface to develop the electrostatic latent image into a toner image on the photoreceptor drum 21 surface. Transfer unit 25 transfers the toner image on the photoreceptor drum 21 surface to the recording paper that is conveyed by paper conveyor 104. Fixing unit 27 heats and presses the recording paper to fix the toner image onto the recording paper. Thereafter, the recording paper is further conveyed by paper conveyor 104 and discharged to a paper output tray 47. In this while, cleaning unit 26 removes and collects the toner left over on the photoreceptor drum 21 surface after transfer.

Here, transfer unit 25 includes a transfer belt 31, drive roller 32, driven roller 33, elastic conductive roller 34 and the like, and rotates transfer belt 31 by supporting and tensioning the belt on the aforementioned rollers 32 to 34 and other rollers. Transfer belt 31 has a predetermined resistivity (e.g., $1\times10^{9}$ to $1\times10^{13}$ Ω·cm) and conveys the recording paper placed on its surface. Elastic conductive roller 34 is pressed against the photoreceptor drum 21 surface with transfer belt 31 in between, so as to press the recording paper on transfer belt 31 against the photoreceptor drum 21 surface. Applied to this elastic conductive roller 34 is an electric field that has a polarity opposite to the charge of the toner image on the photoreceptor drum 21 surface. This electric field of the opposite polarity causes the toner image on the photoreceptor drum 21 surface to transfer to the recording paper on transfer belt 31. For example, when the toner image bears negative (−) charge, the polarity of the electric field applied to elastic conductive roller 34 is set to be positive (+).

Fixing unit 27 includes a heat roller 35 and pressing roller 36. A heater is arranged inside heat roller 35 in order to set the heat roller 35 surface at a predetermined temperature (fixing temperature: approximately 160 to 200 deg. C.). A pair of unillustrated pressing members are arranged at both ends of pressing roller 36 so that pressing roller 36 comes into pressing contact with heat roller 35 with a predetermined pressure. As the recording paper reaches the pressing contact portion called as the fixing nip portion between heat roller 35 and pressing roller 36, the unfixed toner image on the recording paper is fused and pressed while it is being conveyed by the rollers 35 and 36, so that the toner image is fixed to the recording paper.

Paper conveyor 104 includes a plurality of conveying rollers 41 for conveying recording paper, a pair of registration rollers 42, a conveyance path 43, an inversion/conveyance path 44, a plurality of branch claws 45, a pair of paper discharge rollers 46 and the like.

Conveyance path 43 receives recording paper delivered from paper feeder 105 and conveys the recording paper until its leading end reaches registration rollers 42. Since registration rollers 42 are temporarily stopping at that timing, the leading end of the recording paper reaches and abuts registration rollers 42 so that the recording paper bends. The resiliency of this bent recording paper makes the front edge of the recording paper substantially parallel to registration rollers 42. Thereafter, registration rollers 42 start rotating so as to convey the recording paper to transfer unit 25 of printing portion 103 and then further conveyed by paper discharge rollers 46 to paper output tray 47.

Stoppage and rotation of registration rollers 42 can be controlled by switching on or off the clutch between registration roller 42 and its drive shaft or by turning on or off the motor as the drive source of registration rollers 42.

When another image is recorded on the rear side of the recording paper, a plurality of branch claws 45 are turned to switch the paper path from conveyance path 43 to inversion/conveyance path 44 so that the recording paper is turned upside down and returned through inversion/conveyance path 44 to registration roller 42 in conveyance path 43. Thus, another image is recorded on the rear side of the recording paper.

Arranged at the necessary positions along conveyance path 43 and inversion/conveyance path 44 are several sensors for detecting the recording paper position etc., and based on the position of the recording paper detected at each sensor, the drives of the conveying rollers and registration rollers are controlled so as to convey and position the recording paper.

Paper feeder 105 includes a plurality of paper feed trays 51. Each paper feed tray 51 is a tray for holding a stack of recording sheets and is arranged under image forming apparatus 100. Also, each paper feed tray 51 includes a pickup roller or the like for pulling out recording paper sheet by sheet so as to deliver the picked up sheet to conveyance path 43 of recording paper conveyor 104.

Since image forming apparatus 100 of the present embodiment is aimed at high speed printing processing, each paper feed tray 51 has a volume capable of stacking 500 to 1500 sheets of recording paper of a regular size.

Arranged on the flank of image forming apparatus 100 are a large capacity paper cassette (LCC) 52 for accommodating large amounts of a plurality of types of recording paper and a manual feed tray 53 for essentially supplying recording paper of irregular sizes.

Paper output tray 47 is arranged on the side opposite from manual feed tray 53. It is also possible to optionally provide an output paper finisher (for stapling, punching, etc.) or a multi-bin paper output tray, in place of the paper output tray 47.

Figure 3:
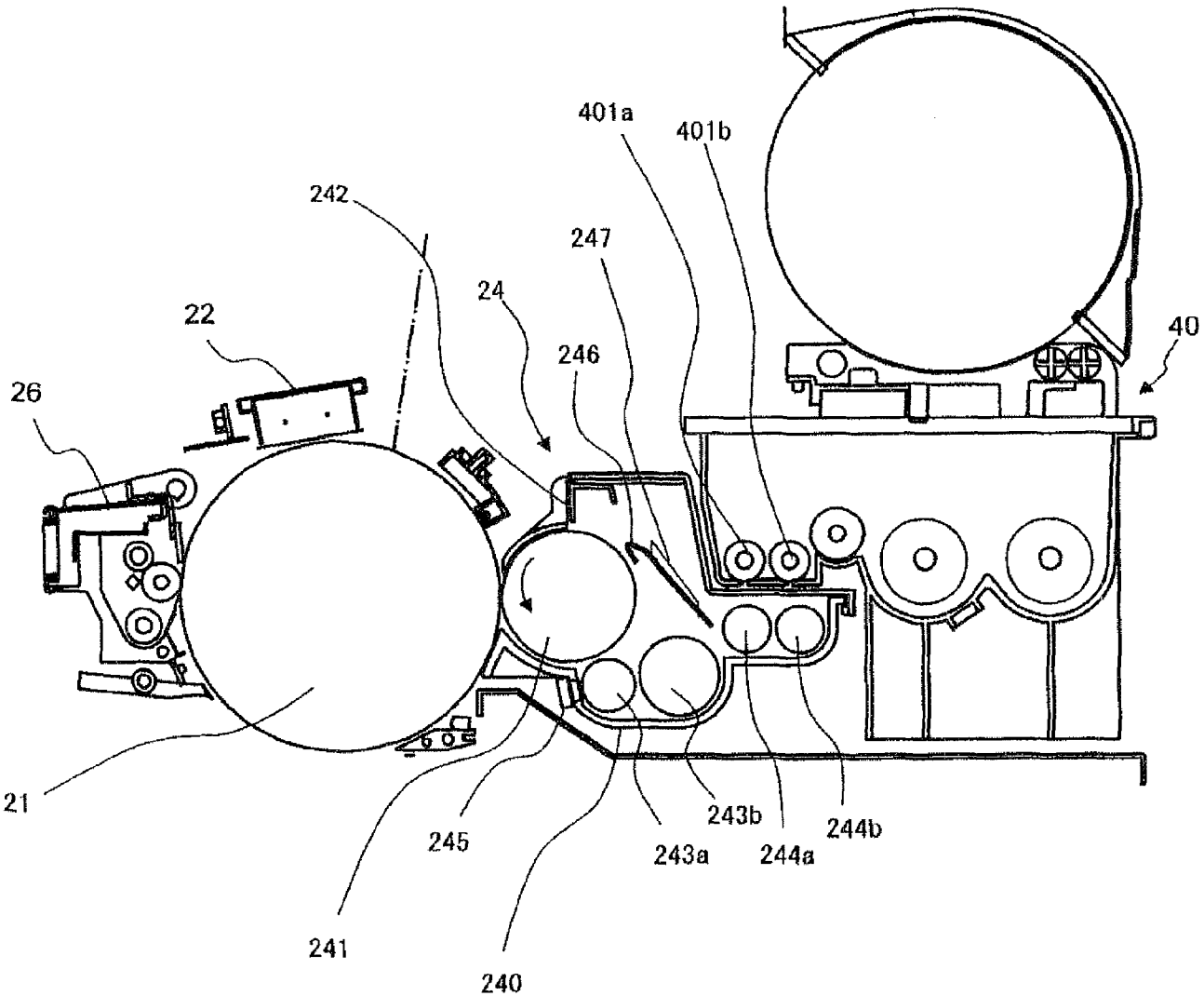
FIG. 3 is an enlarged view schematically showing a configuration around a developing device provided for the image forming apparatus shown in FIG. 2.

Referring next to FIG. 3, a developing device will be outlined. Developing device 24 of this embodiment has the function of developing the electrostatic latent image that has been formed on the surface of the image bearer, i.e., photoreceptor 21 by exposure unit 23 (FIG. 2), to form a visual image with toner. As shown in FIG. 3, developing device 24 includes a toner supply portion 40, a developing hopper 240, a developing roller 241, a layer thickness-regulating member 242, agitating rollers 243 (243*a*, 243*b*), toner agitation rollers 244 (244*a*, 244*b*), a toner concentration sensor 245, a flow-guide plate 246 and partitioning ribs 247.

Developing hopper 240 is a container formed of, for example, a hard synthetic resin, rotatably supporting developing roller 241, agitating rollers 243*a* and 243*b* and toner agitation roller 244*a* and 244*b* and holding toner supplied from toner supply portion 40. In the present embodiment, toner concentration sensor 245 is arranged at a position near agitating roller 243*a* that is located close to developing roller 241 in developing hopper 240 in order to detect the toner concentration of the developer immediately before development that will directly contribute to the development.

In order to obtain the exact toner concentration of the dual-component developer that actually contributes to development by detecting the toner concentration immediately before supply to developing roller 241, toner concentration sensor 245 is disposed in proximity to agitating roller 243*a*. As an example of toner concentration sensor 245, a high-precision magnetic permeability sensor, e.g., TS-L, TS-A and TS-K (trade names of products of TDK Corporation) may be used. The measurement of the toner concentration by toner concentration sensor 245 is output to an unillustrated controller provided for image forming apparatus 100 (FIG. 2). Since the above arrangement of toner concentration sensor 245 at a position immediately before bringing up the developer to developing roller 241 enables detection of the toner concentration immediately before development, it is possible to keep the toner images with high image quality over a long period of time.

Developing roller 241 is arranged opposing photoreceptor 21 and serving as a developer support for supporting the developer that was mixed and agitated inside developing hopper 240 and supplies toner to the developing area where the electrostatic latent image on photoreceptor 21 surface resides as it is rotating in the direction of the arrow shown in FIG. 3 (in the counterclockwise direction in FIG. 3).

Agitating rollers 243*a* and 243*b* are the agitating and conveying members which convey the developer toward developing roller 241 while agitating the dual-component developer of electrostatic toner and magnetic carrier by their rotational drive in developing hopper 240 and which have the developer in developing hopper 240 carried on developing roller 241. The agitating rollers also mix up the developer with the surplus developer that flows down from flow-guide plate 246 and convey the mixture toward developing roller 241.

Toner agitation rollers 244*a* and 244*b* are the rollers that agitate mainly the toner that has fallen from toner supply rollers 401*a* and 401*b* of toner supply portion 40 located over and above developing hopper 240 and convey the toner in developing roller 240.

Layer thickness-regulating member 242 regulates the amount of the developer carried on developing roller 241 to a predetermined thickness while forming spikes of developer from the surplus developer that was rejected by the layer thickness-regulating member 242 and moves the spikes toward flow-guide plate 246 which is located on the right side in FIG. 3.

Flow-guide plate 246 is a flow-guide plate member that flows down the surplus developer that was rejected by layer thickness-regulating member 242 toward and between agitating roller 243*b* and toner agitation roller 244*a*, which are located away from layer thickness-regulating member 242. The surplus developer having transferred over flow-guide plate 246 slides down over the slope of flow-guide plate 246 and flows down toward and between agitating roller 243*b* and toner agitation roller 244*a*.

Partitioning rib 247 is a diffusing element that flows the surplus developer downward in the predetermined direction whilst diffusing the developer with respect to the longitudinal direction of developing roller 241 in order to prevent the surplus developer from going too far to one side and make the carried amount of developer uniform across the length of developing roller 241. There are a plurality of partitioning ribs 247 arranged upright on flow-guide plate 246. In the present embodiment, the drive of partitioning ribs 247 is controlled so that the direction in which the surplus developer flows down is made to change periodically. The configuration of the downflow direction turning mechanism and the switching drive control for periodically turning the downflow direction of the surplus developer by partitioning ribs 247 will be described later.

Figure 4:
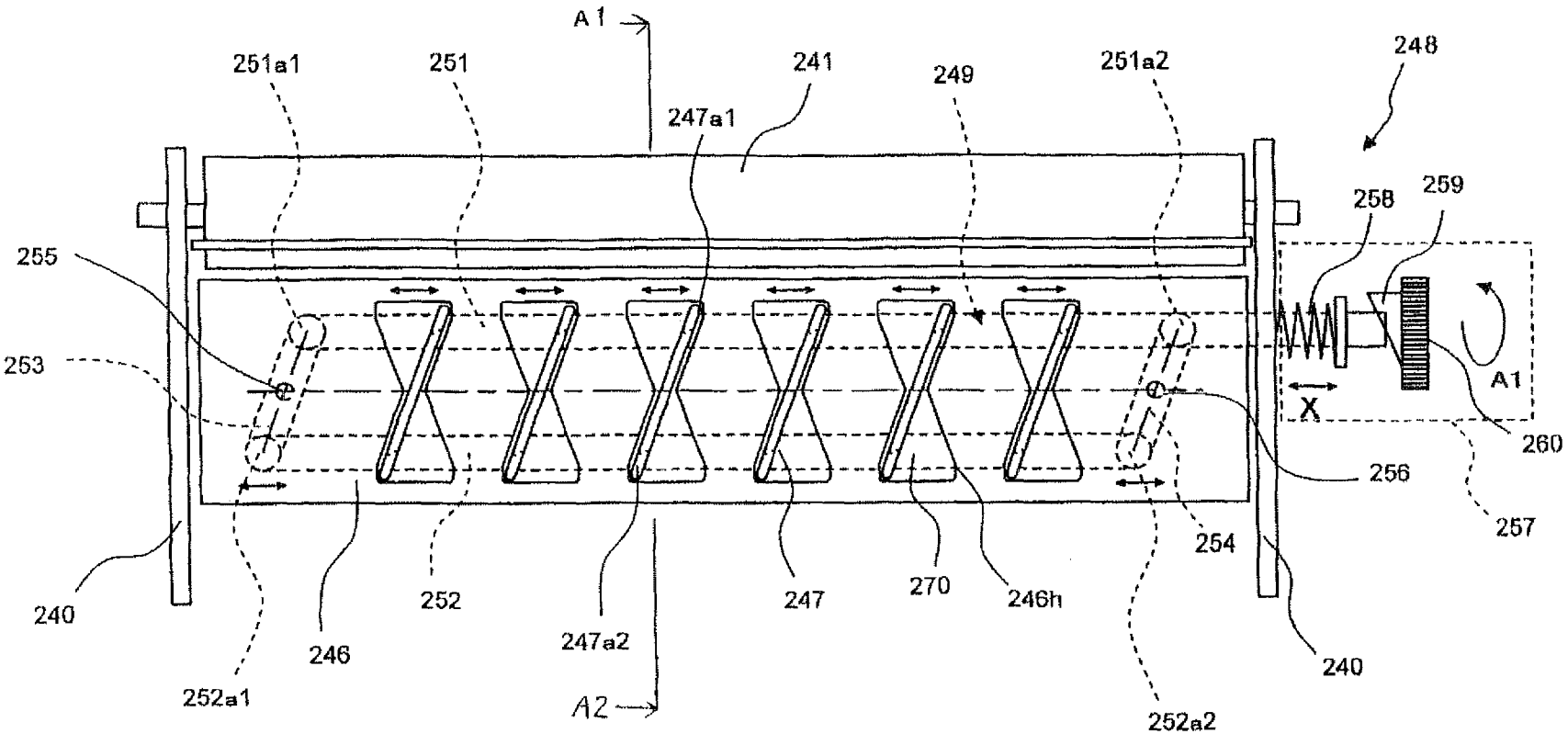
FIG. 4 is a schematic top view showing a developing device of the same embodiment with its top cover removed.
Figure 5:
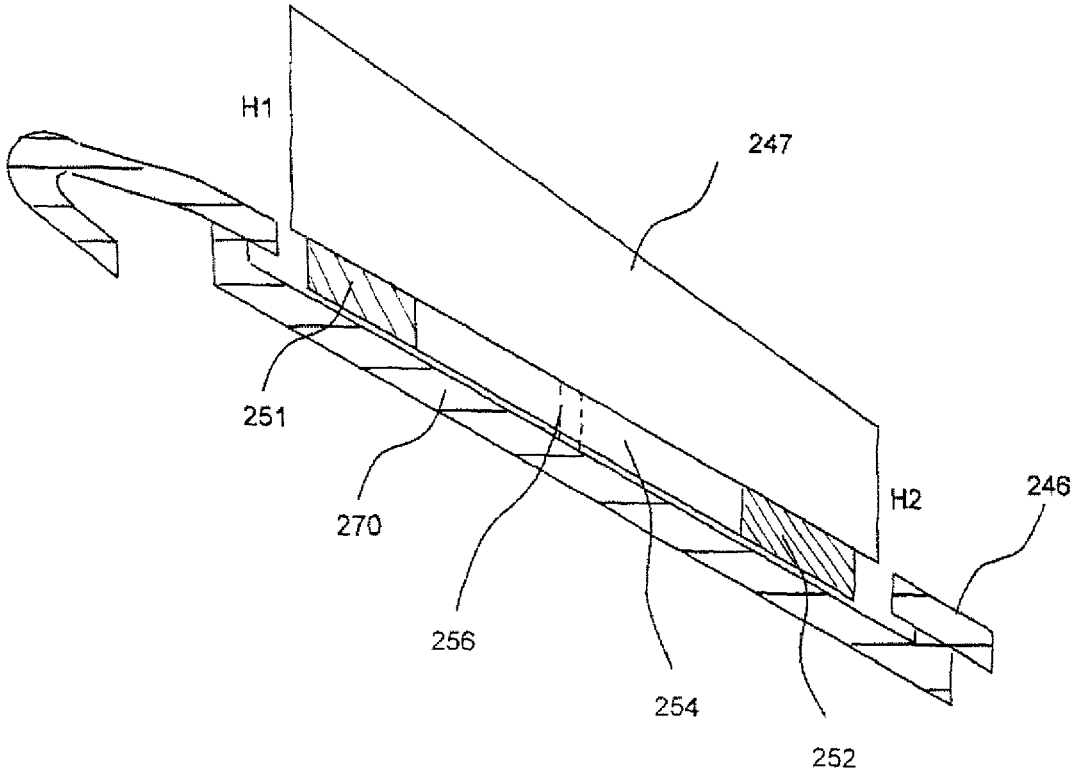
FIG. 5 is a sectional view of a flow-guide plate shown in FIG. 4, cut along a plane A1-A2.

Next, the configuration and operation of the downflow direction turning mechanism provided for the developing device in the present embodiment will be specifically described. FIG. 4 is a schematic top view showing the developing device of the present embodiment with its top cover removed, and FIG. 5 is a sectional view of FIG. 4, cut along a plane A1-A2.

As described above, in this embodiment, a plurality of (six in the example shown in FIG. 4) partitioning ribs 247 are provided approximately parallel to each other. These partitioning ribs 247 are driven and controlled by a downflow direction turning mechanism 248 so that the downflow direction of the surplus developer will change periodically.

Each partitioning rib 247 is pivotally supported at both ends 247*a*1, 247*a*2 on their proximal sides by a pair of supporting rod members 251 and 252 which are arranged on the side (underside) of flow-guide plate 246 opposite from the side where the ribs are projected upright. These supporting rod members 251 and 252 are pivotally supported at both ends thereof, designated at 251*a*1 and 251*a*2, and at 252*a*1 and 252*a*2, respectively, by a pair of connection rod members 253 and 254, forming a set of linkage mechanism 249 made up of a pair of supporting rod members 251 and 252 and a pair of connecting rod members 253 and 254.

Connecting rod members 253 and 254 are rotationally supported at their approximately centers by fulcrums 255 and 256, respectively, so as to reciprocate supporting rod members 251 and 252 in the longitudinal direction of developing roller 241 (the X-direction shown in FIG. 4) pivoting on the two fulcrums 255 and 256.

Further, in the present embodiment, a reciprocation drive mechanism 257 for reciprocatingly moving supporting rod member 251 in the longitudinal direction (the X-direction shown in FIG. 4) of developing roller 241 is disposed outside developing hopper 240. This reciprocation drive mechanism 257 is comprised of a power transmitter 258 such as a plunger etc. for reciprocatingly moving supporting rod member 251 in the X-direction and a gear 260 having a tapered element 259 that abuts the power transmitter 258 and an unillustrated drive motor that rotates gear 260 in the direction of A1 shown in FIG. 4. That is, supporting rod members 251 and 252 of linkage mechanism 249 are reciprocated in the X-direction, pivoting on two fulcrums 255 and 256, by rotational drive of the gear 260. With the thus constructed reciprocation drive mechanism 257, six partitioning ribs 247 are pivotally supported by supporting rod member 251 that is supported at both ends 251*a*1 and 251*a*2 and supporting rod member 252 that is supported at both ends 252*a*1 and 252*a*2, so that both ends 247*a*1 and 247*a*2 of each partitioning rib 247 can reciprocate in the X-direction. Thus, it is possible to turn the regulating direction of partitioning ribs 247 for regulating the downflow direction of surplus developer flowing down over guide-plate 246.

In the above way, in the present embodiment, downflow direction turning mechanism 248 is constructed so as to cause supporting rod members 251 and 252 of linkage mechanism 249 to reciprocate in the X-direction, pivoting on two fulcrums 255 and 256, hence it is possible to change the direction that is regulated by partitioning ribs 247 which are rotatably supported at their ends on supporting rod members 251 and 252.

Further, flow-guide plate 246 is formed with cutouts 246*h* having a shape like the section of a sandglass as shown in FIG. 4, in the areas corresponding to the reciprocating motion of partitioning ribs 247, so that partitioning ribs 247 will not be hindered in their reciprocating motion.

Also, as shown in FIG. 5, a surplus developer receiver 270 for preventing the surplus developer flowing over flow-guide plate 246, from falling is provided under cutouts 246*h* that are formed in flow-guide plate 246.

Partitioning rib 247 is formed so that its height H1 is greater (6 mm as an example) on the side closer to layer thickness-regulating member 242 (on the left side in FIG. 5) and its height H2 smaller (3 mm as an example) on the side more distant from layer thickness-regulating member 242 (on the right side in FIG. 5). That is, since a certain amount of surplus developer is returned from developing roller 241 in the area close to the layer thickness-regulating member (on the left side in FIG. 5), each partitioning rib 247 of the present embodiment needs to be equal to or higher than a certain height so as not to allow the developer to converge to a particular partitioning rib 247 and so as to make the amount of the developer in each passage between partitioning ribs 247 uniform. On the other hand, in the rear half of the flowing movement of the surplus developer over flow-guide plate 246, the height of the collection of developer has been made substantially even by the reciprocating movement of partitioning ribs 247, so that each partitioning rib 247 is formed to be low so as to allow the developer in each passage between partitioning ribs 247 to mix with that in adjacent one. The formation of partitioning ribs 247 so that their height from the flow-guide plate 246 surface becomes lower in the above way as it goes downstream, makes it possible to positively distribute the surplus developer on the entrance side of flow-guide plate 246 and make the surplus developer in adjacent passages between partitioning ribs 247 mix up by lowering partitioning ribs 247 in the rear half thereof. As a result, it is possible to make the developer concentration uniform with high precision.

Figure 6:
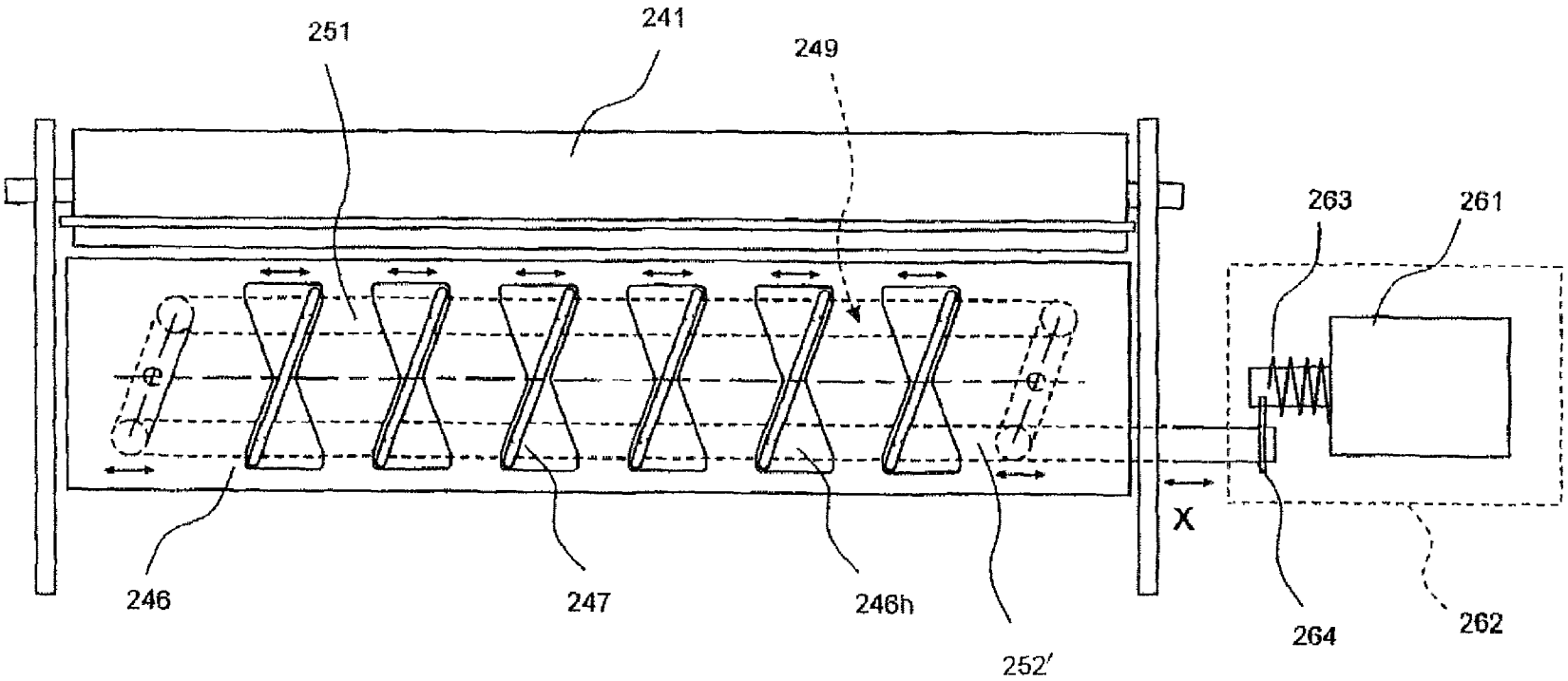
FIG. 6 is a schematic top view showing a variational example of a developing device of the same embodiment with its top cover removed.

As another example of the reciprocation drive mechanism for driving linkage mechanism 249, a reciprocation drive mechanism 262 using a solenoid 261 as shown in FIG. 6 may be used. Illustratively, a plunger 263 of solenoid 261 expands or contacts to cause a supporting rod member 252' of linkage mechanism 249 to reciprocate in the X-direction by means of a drive transmitter 264 with which plunger 263 is engaged, whereby the ends 247*a*1 and 247*a*2 of each partitioning rib 247 reciprocate with respect to fulcrums 255 and 256. In other words, supporting rod member 252' of linkage mechanism 249 moves reciprocatingly in the X-direction so as to change the regulating direction of partitioning ribs 247 and regulate the surplus developer that flows down over flow-guide plate 246.

Figure 7:
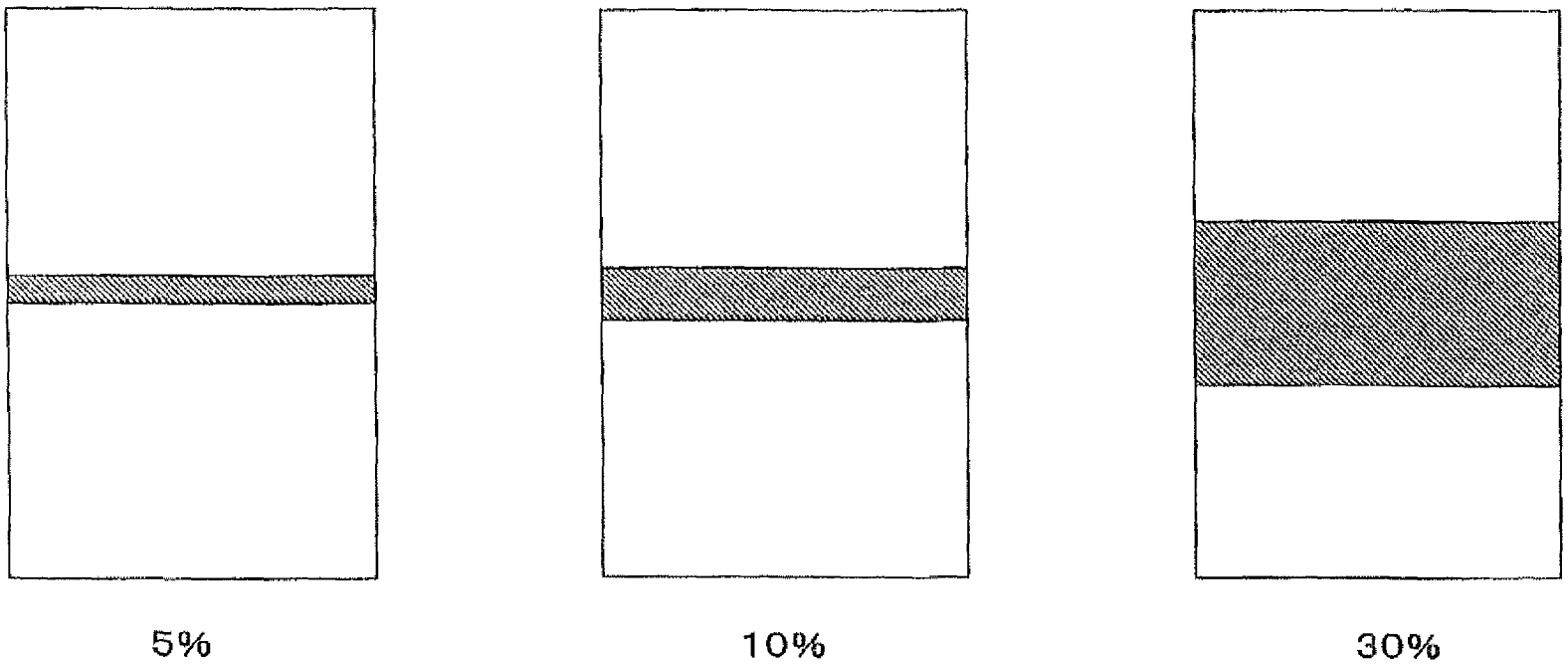
FIG. 7 shows print patterns for evaluating examples to determine suitable set conditions for a printing operation using the developing device of the same embodiment; and, FIG. 8 is a table showing the set conditions in examples and comparative examples and evaluation on image quality to determine suitable set conditions for a printing operation using the developing device of the same embodiment.

Next, examples and comparative examples for determining suitable set conditions for an image forming (printing) operation with the developing device of the present embodiment will be described. FIG. 7 shows print patterns for evaluating the examples to determine suitable set conditions for the printing operation with the developing device of the present embodiment. FIG. 8 is a table showing the set conditions in the examples and comparative examples and evaluation on the image quality to determine suitable set conditions for the printing operation of the developing device of the same embodiment.

Examples 1 to 3 and Comparative Examples 1 to 2

In examples 1 to 3, A4-sized originals having 5%, 10% and 30% solid strip printing patterns as shown in FIG. 7 were used to perform continuous printing tests of 500 sheets using the above-described developing device 24 of the first embodiment with a dual-component developer containing 6% toner. After continuous printing of 500 sheets, the developer was sampled from the upper part of the conveyor roller so that the toner concentration was measured. In measuring the toner concentration, a solvent method was used and the developer was sampled from three points, namely, front side (F), center (C) and rear side (R) in the developing hopper. The test was done with developing roller 241 driven at a rotational speed of 864 mm/sec. Evaluation on the image quality after 500 printouts was done based on the variation of the printed density at the central part using a reflective densitometer (RD918: a product of MACBETH) for evaluation. As comparative examples 1 and 2, similar evaluation tests were carried out with the partitioning ribs inactive.

Example 4 and Comparative Example 3

In example 4, a continuous printing test of 500 sheets was performed using the A4-sized original having a 10% solid strip printing pattern in the same manner as in example 1 except that the rotational speed of developing roller 241 was set at 432 mm/sec. After continuous printing of 500 sheets, the developer was sampled from the upper part of the conveyor roller so that the toner concentration was measured in the same manner. Evaluation on the image quality after 500 printouts was done similarly based on the variation of the printed density at the central part. Further, as comparative example 3, a similar evaluation test was carried out with the partitioning ribs inactive.

Examples 5 to 7

In examples 5 to 7, continuous printing tests were performed using the A4-sized original having a 10% solid strip printing pattern in the same manner except that the rotational speed of the developing roller was set at 864 mm/sec, the developing roller was continuously driven for 30 min. or for 60 min, and ten reciprocating movements of the partitioning ribs were added every 15 minutes. After continuous printing, the developer was sampled from the upper part of the conveyor roller so that the toner concentration was measured in the same manner. Evaluation on the image quality at the end of printing was done based on the variation of the printed density at the central part. In example 7, no additional reciprocating motion of the partitioning ribs was done.

The results of the above examples and comparative examples were summarized in Table 1 shown in FIG. 8. As to evaluation of toner concentration, as long as the difference before and after printing fell within 0.1 wt % in absolute value or the difference in image density fell within 0.1, the result was regarded as a practically permissible level or OK level.

As in Table 1 in FIG. 8, it was found from the comparison between examples 1 to 3 and comparative examples 1 and 2 that the difference in toner concentration between before and after printing can be suppressed and sharp printed images can be obtained by performing reciprocating movement of the partitioning ribs provided on the flow-guide plate and also by increasing the number of reciprocations of the partitioning ribs with increase of printing pattern area (coverage ratio). That is, if, as a usual case, unbalanced print patterns continue as a print job, the developer concentration may become locally uneven across the length of the developing roller. However, it was found that even in such a case, if an unillustrated controller of the image forming apparatus is adapted to control or change the cycle in which the downflow direction turning mechanism turns the downflow direction regulated by the partitioning ribs, in accordance with the status of the print patterns, or in accordance with the amount of developer to be consumed in the developing roller, based on the area separation analysis on the print information, it is possible to make the toner concentration uniform with a higher precision.

Further, it was found from the comparison between examples 2, 4 and comparative example 3 that the difference in toner concentration between before and after printing can be suppressed and sharp printed images can be obtained by performing reciprocating movement of the partitioning ribs and also by increasing the number of reciprocations per minute with increase of the rotational speed of the developing roller. That is, it is usual that the rotational speed of the developing roller is changed with the change of the processing speed of print paper in image forming. However, as the processing speed is increased, the mixing and agitation performance of the dual-component developer lowers. To deal with this situation, it was found that if the controller of the image forming apparatus is adapted to control or change the cycle in which the downflow direction turning mechanism turns the downflow direction to be shorter, it is possible to make the toner concentration uniform with a higher precision.

Further, it was found from examples 5 and 6 that the difference in toner concentration between before and after printing can be suppressed and sharp printed images can be obtained by performing additional reciprocating movement of the partitioning ribs if the continuous drive time of the developing roller becomes long. That is, it is usual that the fluidity and the mixing and agitation performance of the dual-component developer become lowered as use of the developer becomes longer. To deal with this situation, it was found that if the controller of the image forming apparatus is adapted to additionally drive the downflow direction turning mechanism for turning the downflow direction by the partitioning ribs, in accordance with the continuous drive time of the developing roller, it is possible to make the toner concentration uniform with a higher precision.

From the above result of the examples and comparative examples, it was found that the surplus developer that flows down can be uniformly diffused with respect to the longitudinal direction of the developer support, i.e., the developing roller and the mixing and agitation performance in the developing hopper can be improved since the developing device is driven and controlled such that the surplus developer collected by the flow-guide plate flows down in a varying direction that is regulated and changed periodically by the partitioning ribs of the downflow direction turning mechanism. Accordingly, it was found that image unevenness originating from the developer can be prevented since toner concentration can be made uniform across the length of the developing roller.

Having described the preferred embodiment with reference to the attached drawings, it goes without saying that the technology should not be limited to the above-described examples, and it is obvious that various changes and modifications will occur to those skilled in the art within the scope of the appended claims. Such variations are therefore understood to be within the technical scope of the technology.

For example, in the above embodiment, the developing device is applied to a monochrome image forming apparatus having one toner cartridge mounted therein, but the developing device of the technology can also be applied to a color image forming apparatus.

What is claimed is:

1. A developing device for developing an electrostatic latent image formed on an image bearer with a developer that has been triboelectrically-charged by mixing and agitation of two components, toner and magnetic carrier, comprising:

a developing hopper for storing the developer;

an agitation and conveying member that is rotated inside the developing hopper for conveying the developer while agitating;

a developer support which supports the developer that has been mixed and agitated inside the developing hopper and supplies the developer whilst rotating to a developing area located opposing the image bearer;

a layer thickness-regulating member for regulating the layer thickness of the developer being conveyed by the developer support;

a flow-guide plate member for flowing down the surplus developer that was rejected by the layer thickness-regulating member to a place located away from the layer thickness-regulating member;

a plurality of diffusing elements arranged upright on the flow-guide plate member for flowing down the surplus developer in a predetermined direction whilst diffusing the developer with respect to the longitudinal direction of the developer support; and a downflow direction turning mechanism that controls the diffusing elements so as to periodically turn the downflow direction of the surplus developer regulated by the diffusing elements every time a predetermined period of time has elapsed while the developer support is driven.

2. The developing device according to claim 1, wherein the downflow direction turning mechanism is driven and controlled so as to change the cycle of turning the downflow direction which is regulated by the diffusing elements, in accordance with the amount of developer consumed from the developer support.

3. The developing device according to claim 1, wherein the downflow direction turning mechanism is driven and controlled so as to change the cycle of turning the downflow direction which is regulated by the diffusing elements, in accordance with the rotational speed of the developer support.

4. The developing device according to claim 1, wherein the diffusing element is formed such that the height from the surface of the flow-guide plate member on which the diffusing element is set becomes smaller as it goes in the downflow direction.

5. The developing device according to claim 1, further comprising a toner concentration detector that is arranged in the proximity to the area where the developer is supplied from the agitating and conveying member to the developer support, to detect the toner concentration of the developer.

6. An image forming apparatus comprising an image bearer for supporting an electrostatic latent image, and a developing device according to claim 1 for visualizing the electrostatic latent image on the image bearer with toner.

7. The developing device according to claim 1, wherein apertures are formed in the flow-guide plate member, wherein the plurality of diffusing elements are mounted on supporting rods located under the flow-guide plate member, and wherein the plurality of diffusing elements extends upward through respective apertures in the flow-guide plate member.

8. The developing device according to claim 7, wherein the downflow direction turning mechanism causes the support rods to move, thereby moving the diffusing elements, which turns the downflow direction of the surplus developer regulated by the diffusing elements.

9. A developing device for developing an electrostatic latent image formed on an image bearer with a developer that has been triboelectrically-charged by mixing and agitation of two components, toner and magnetic carrier, comprising:

a developing hopper for storing the developer;

an agitation and conveying member that is rotated inside the developing hopper for conveying the developer while agitating;

a developer support which supports the developer that has been mixed and agitated inside the developing hopper and supplies the developer whilst rotating to a developing area located opposing the image bearer;

a layer thickness-regulating member for regulating the layer thickness of the developer being conveyed by the developer support;

a flow-guide plate member for flowing down the surplus developer that was rejected by the layer thickness-regulating member to a place located away from the layer thickness-regulating member;

a plurality of diffusing elements arranged upright on the flow-guide plate member for flowing down the surplus developer in a predetermined direction whilst diffusing the developer with respect to the longitudinal direction of the developer support; and a downflow direction turning mechanism that controls the diffusing elements so as to periodically turn the downflow direction of the surplus developer regulated by the diffusing elements, and wherein the downflow direction turning mechanism is driven and controlled so as to change the cycle of turning the downflow direction regulated by the diffusing elements in accordance with a rotational speed of the developer support.

10. The developing device according to claim 9, wherein the downflow direction turning mechanism is also driven and controlled so as to change the cycle of turning the downflow direction regulated by the diffusing elements in accordance with the amount of developer consumed from the developer support.

11. The developing device according to claim 9, wherein the plurality of diffusing elements are formed such that a height of the diffusing elements above a surface of the flow-guide plate member on which the diffusing elements are set becomes smaller in the downflow direction.

12. An image forming apparatus comprising an image bearer for supporting an electrostatic latent image, and a developing device according to claim 9 for visualizing the electrostatic latent image on the image bearer with toner.

13. A developing device for developing an electrostatic latent image formed on an image bearer with a developer that has been triboelectrically-charged by mixing and agitation of two components, toner and magnetic carrier, comprising:

a developing hopper for storing the developer;

an agitation and conveying member that is rotated inside the developing hopper for conveying the developer while agitating;

a developer support which supports the developer that has been mixed and agitated inside the developing hopper and supplies the developer whilst rotating to a developing area located opposing the image bearer;

a layer thickness-regulating member for regulating the layer thickness of the developer being conveyed by the developer support;

a flow-guide plate member for flowing down the surplus developer that was rejected by the layer thickness-regulating member to a place located away from the layer thickness-regulating member;

a plurality of diffusing elements arranged upright on the flow-guide plate member for flowing down the surplus developer in a predetermined direction whilst diffusing the developer with respect to the longitudinal direction of the developer support, wherein the diffusing elements are formed such that a height of the diffusing elements above a surface of the flow-guide plate member on which the diffusing elements are set becomes smaller in the downflow direction; and a downflow direction turning mechanism that controls the diffusing elements so as to periodically turn the downflow direction of the surplus developer regulated by the diffusing elements.

14. The developing device according to claim 13, wherein the downflow direction turning mechanism is driven and controlled so as to change the cycle of turning the downflow direction which is regulated by the diffusing elements, in accordance with the amount of developer consumed from the developer support.

15. An image forming apparatus comprising an image bearer for supporting an electrostatic latent image, and a developing device according to claim 13 for visualizing the electrostatic latent image on the image bearer with toner.

* * * * *